US005162693A

United States Patent [19]

Van Der Leeuw et al.

[11] Patent Number: 5,162,693

[45] Date of Patent: Nov. 10, 1992

[54] HIGH-PRESSURE DISCHARGE LAMP

[75] Inventors: Bart Van Der Leeuw, Eindhoven, Netherlands; Danny L. V. Hermans, Turnhout, Belgium

[73] Assignee: U.S. Philips Corporation, New York, N.Y.

[21] Appl. No.: 423,904

[22] Filed: Oct. 19, 1989

[30] Foreign Application Priority Data

Oct. 24, 1988 [NL] Netherlands ..... 8802610

[51] Int. Cl.[5] ..... H01J 17/28; H01J 61/10; H01J 61/35

[52] U.S. Cl. ..... 313/27; 313/113; 313/635

[58] Field of Search ..... 313/25, 27, 39, 40, 313/44, 635, 113

[56] References Cited

U.S. PATENT DOCUMENTS 3,842,304 10/1974 Beyer et al. ..... 313/635 X
4,305,015 12/1981 Honda et al. ..... 313/113

FOREIGN PATENT DOCUMENTS 615940 2/1949 United Kingdom .

*Primary Examiner*—Sandra L. O'Shea
*Attorney, Agent, or Firm*—Brian J. Wieghaus

[57] ABSTRACT

The lamp vessel of a high-pressure discharge lamp locally has a coating, which is a smooth, solitary, metallically reflecting graphite film. The graphite film, which increases the temperature of comparatively cold parts of the lamp vessel, can readily be applied and has an excellent adhesion.

3 Claims, 1 Drawing Sheet

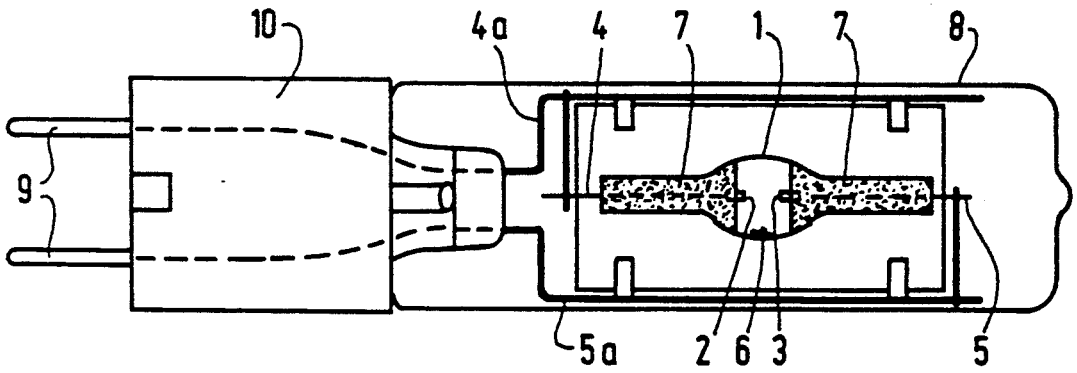
10
4a
4
7
1
7
8
9
5a
2
6
3
5

HIGH-PRESSURE DISCHARGE LAMP

BACKGROUND OF THE INVENTION

The invention relates to a high-pressure discharge lamp provided with a lamp vessel sealed in a vacuum-tight manner, electrodes arranged in the lamp vessel, current supply conductors extending from the electrodes through the wall of the lamp vessel to the exterior, an ionizable filling in the lamp vessel comprising a rare gas constituent and an evaporable constituent, and a carbon coating on the lamp vessel, which laterally surrounds at least one of the current supply conductors.

Such a lamp is known from GB 615940.

In high-pressure discharge lamps, the wall of the lamp vessel during operation has a comparatively low temperature at the area at which said lamp vessel laterally surrounds a current supply conductor. The evaporable constituent of the ionizable filling can accumulate at this area and can thus be withdrawn from the discharge arc. This influences the spectrum of the radiation emitted by the lamp.

According to the aforementioned British Patent Specification, the lamp vessel therefore has a non-reflecting coating of carbon powder applied by means of a suitable binder. Other powders used for this purpose are thorium oxide and black metal powder, for example tungsten powder. The increase in temperature of the coated wall portion is obtained according to this Patent Specification in that the coating assumes a comparatively high temperature due to absorption of radiation generated by the lamp, although the coating itself supplies energy to the environment by radiation.

A disadvantage of the known coating and of other usual powder coatings, such as $ZrO_2$ powder coatings, it that it is difficult to manufacture the coating in a reproducible manner, that suspension agents are used which must be expelled later on and that it may be necessary to manufacture the coating in two cycles of immersing or smearing and baking. Due to the powder particles in the coating, the coating has a rough surface and is dull black when carbon is used. There is a risk that the coating keeps volatile constituents absorbed or adsorbed, which are eventually released or desorbed during operation of the lamp. When the lamp burns in an evacuated outer envelope, the vacuum is reduced due to this desorption.

Further, the adhesion of such a coating to the lamp vessel is poor, as a result of which the coating is liable to be damaged.

The aforementioned British Patent Specification further indicates that it is known to provide a lamp vessel locally with a reflecting gold or platinum layer and that the use of these metals is expensive.

SUMMARY OF THE INVENTION

The invention has for its object to provide a high-pressure discharge lamp of the kind described in the opening paragraph, which has an effective and inexpensive coating, which can readily be applied.

In the high-pressure discharge lamp according to the invention, this object is achieved in that the carbon coating is a smooth metallically reflecting graphite film.

The coating of the lamp according to the invention is effective, as appears from the stable location of the colour point of the radiation emitted by the lamp in the colour triangle. The coating is inexpensive and can readily be applied. In order to obtain the coating, the lamp vessel is locally brought into contact with a hydrocarbon while it is at a high temperature, for example at 1200° C. This hydrocarbon is decomposed and a smooth continuous graphite film with reflecting surfaces of metallic appearance is obtained. The film has an excellent adhesion to the lamp vessel and can hardly be removed, even by scratching with a sharp article, such as a sharply pointed stainless steel pin. It has been found that the film, when used in a vacuum, does not adversely affect the vacuum. It is very easy to use a gaseous hydrocarbon or a mixture of gaseous hydrocarbons, for example natural gas, and to apply the film when the lamp vessel is still hot after a processing step, for example a processing step in which a vacuum-tight pinch or seal of the lamp vessel has been realized.

The current supply conductors can enter the lamp vessel opposite to each other or beside each other. In the latter case, the film laterally surrounds both current supply conductors. If a lamp in which the current supply conductors enter opposite to each other is operated in vertical position, only the film surrounding the lower current supply conductor is necessary because the upper part of the lamp vessel is already brought to a comparatively high temperature by flow of gas within the lamp vessel. If the lamp is intended for operation in another position, both current supply conductors may be surrounded by a film.

BRIEF DESCRIPTION OF THE DRAWING

An embodiment of the high-pressure discharge lamp according to the invention is shown in the drawing in side elevation.

DESCRIPTION OF THE PREFERRED EMBODIMENT

In the drawing, the high-pressure discharge lamp has a lamp vessel 1 of quartz glass sealed in a vacuum-tight manner. Electrodes 2, 3 are arranged in the lamp vessel. Current supply conductors 4, 5 extend from the electrodes 2, 3 through the wall of the lamp vessel 1 to the exterior. The lamp vessel 1 has a coating 7 on the lamp vessel, which laterally surrounds at least one of the current supply conductors 4, 5.

The carbon coating 7 in both events is a smooth metallically reflecting graphite film. The lamp vessel 1 is arranged in an evacuated outer envelope 8. The current supply conductors 4, 5 are connected to conductors **4*a*, 5*a*, which are connected to contact pins 9 of a lamp cap 10. The evaporable constituent 6** comprises $DyI_3$, TlI, CsI and Hg. During operation, the lamp consumes a power of 150 W. The light emitted by the lamp has a colour point with a stable location in the colour triangle. It has been found that the graphite films do not adversely influence the vacuum in the outer envelope.

We claims:

1. A high-pressure discharge lamp comprising a lamp vessel sealed in a vacuum-tight manner, electrodes arranged in the lamp vessel, current supply conductors extending from the electrodes through the wall of the lamp vessel to the exterior, an ionizable filling in the lamp vessel comprising a rare gas constituent and an evaporable constituent, and a carbon coating on the lamp vessel, which laterally surrounds at least one of the current supply conductors, characterized in that the carbon coating is a smooth metallically reflecting graphite film.

2. In a high pressure discharge lamp comprising a discharge vessel having a discharge electrode spaced from a wall of said vessel, an ionizable filling in the discharge vessel comprising a rare gas constituent and an evaporable constituent, and a coating on a portion of said discharge vessel adjacent said electrode for raising the temperature of said portion during lamp operation, characterized in that:

said coating is a smooth metallically reflecting graphite film.

3. In a high pressure discharge lamp comprising a discharge vessel having opposing sealed ends, an ionizable filling in the discharge vessel comprising a rare gas constituent and an evaporable constituent, electrodes disposed in said discharge vessel between which a discharge is maintained during lamp operation, current-supply conductors extending from said electrodes through said sealed ends to the exterior, and a carbon coating on a sealed end adjacent the respective electrode, characterized in that:

said carbon coating is a smooth metallically reflecting graphite film.

* * * * *